US008197350B2

(12) United States Patent
Sonner et al.

(10) Patent No.: US 8,197,350 B2
(45) Date of Patent: Jun. 12, 2012

(54) PORTABLE RIDE-ON BOUNCING AND SPINNING TOY

(75) Inventors: Robert Sonner, South Wales, NY (US); Patrick Ritossa, Orchard Park, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 12/837,713

(22) Filed: Jul. 16, 2010

(65) Prior Publication Data

US 2010/0279782 A1 Nov. 4, 2010

Related U.S. Application Data

(63) Continuation of application No. 11/549,153, filed on Oct. 13, 2006, now Pat. No. 7,780,500.

(51) Int. Cl.
*A63G 13/06* (2006.01)
*A63G 13/00* (2006.01)

(52) U.S. Cl. ..... 472/95; 472/103; 472/135

(58) Field of Classification Search ..... 472/95, 472/96, 98, 102–104, 106, 110, 135; 446/175, 446/227

See application file for complete search history.

(56) References Cited

U.S. PATENT DOCUMENTS

| | | | |
|---|---|---|---|
| 1,518,671 | A | 12/1924 | Novinsky |
| 2,704,111 | A | 3/1955 | Wunderlich |
| D189,456 | S | 12/1960 | Hansen |
| 2,971,758 | A | 2/1961 | Zimmers |
| 3,049,350 | A | 8/1962 | Walker |
| 3,180,640 | A | 4/1965 | Lawrence |
| 3,578,381 | A | 5/1971 | Young |
| 3,595,569 | A | 7/1971 | Holte |
| 3,730,587 | A | 5/1973 | Bloxham et al. |
| 4,160,553 | A | 7/1979 | Fleischer |
| D265,224 | S | 6/1982 | Bollen et al. |
| 4,379,550 | A | 4/1983 | Petersen |
| 5,211,607 | A | 5/1993 | Fermaglish et al. |
| 5,415,590 | A | 5/1995 | Steingraber et al. |
| 5,451,093 | A | 9/1995 | Petrie et al. |

(Continued)

FOREIGN PATENT DOCUMENTS

FR 2781138 1/2000

OTHER PUBLICATIONS

Evenflo SmartSteps ExerSaucer, http://www.target.com/gp/detail.html/sr=1-2/qid=1162825650/ref=sr_1_2/601-8096405-2105733?ie=UTF8&asin=B0002PR43O, Nov. 6, 2006.

*Primary Examiner* — Kien Nguyen
(74) *Attorney, Agent, or Firm* — Edell, Shapiro & Finnan, LLC

(57) ABSTRACT

A ride-on activity device is disclosed, wherein the device includes a seat, a base and a connector for movably connecting the seat relative to the base. The connection between the seat and the base allows multiple degrees of freedom such that the seat is capable of bouncing and rotating relative to the base. The connection between the seat and the connector includes a rotation safety mechanism that allows rotation at the connection when the seat is occupied by a user and prevents rotation at the connection when the seat is unoccupied. Furthermore, the connector includes a resilient member that allows the seat to bounce vertically relative to the base.

25 Claims, 11 Drawing Sheets

U.S. PATENT DOCUMENTS

| | | | | |
|---|---|---|---|---|
| 5,688,211 | A | 11/1997 | Myers | |
| 5,934,747 | A | 8/1999 | Garland | |
| 5,935,010 | A | 8/1999 | Clarke | |
| 6,178,978 | B1 | 1/2001 | Rieber | |
| 6,203,395 | B1 | 3/2001 | McElhaney | |
| 6,299,247 | B1 | 10/2001 | Meeker et al. | |
| 6,332,824 | B2 | 12/2001 | Tell et al. | |
| 6,425,842 | B1 | 7/2002 | Stern et al. | |
| 6,533,672 | B1 | 3/2003 | Keller et al. | |
| 6,869,368 | B1 | 3/2005 | Clarke et al. | |
| 7,775,893 | B2 * | 8/2010 | Blumenthal | 472/95 |
| 2004/0198501 | A1 | 10/2004 | Henderson | |

* cited by examiner

PORTABLE RIDE-ON BOUNCING AND SPINNING TOY

CROSS REFERENCE TO RELATED APPLICATIONS

The present application is a continuation of U.S. Nonprovisional application Ser. No. 11/549,153, filed 13 Oct. 2006 and entitled "Portable Ride-On Bouncing and Spinning Toy," the disclosure of which is hereby incorporated by reference in its entirety.

BACKGROUND OF THE INVENTION

The present invention relates to a ride-on toy stylized as a friendly character. Such toys are also often styled in a saddle-type configuration including a saddle-type seat. The toy is typically connected to the supporting surface by a connector. The connector can include a motorized member that moves the seat automatically or a biasing member that manually reacts to the movement of the child. Whether the toy and connector are motorized or self-powered, children get excited about and spend endless hours enjoying such ride-on toys. Generally, the connector supports the seat, allowing the seat to move in various directions. Specifically, in addition to an up and down (vertical) riding (bouncing) motion, some connectors of ride-on toys enable rotation or spinning of the seat while the child is sitting on the seat. Although rotation of the seat is desirable after the child has been seated on the toy, the climbing onto or off of a rotating toy may be somewhat difficult.

Parents generally encourage children to play independently as early as possible. For a small child, however, the rotation and bouncing of the seat on a conventional ride-on device can make an unsupervised mounting of such toys an unstable and even potentially dangerous undertaking. There is therefore a need to develop a ride-on toy which allows relative rotation between the seat and connector, but which prevents rotation of the seat when the child is mounting the toy and then again allows rotation of the seat after the child has safely mounted the toy. In this way, the child can safely mount the toy and then safely enjoy the freedom of seat rotation and bouncing.

SUMMARY OF THE INVENTION

Generally, the present specification discloses a children's ride-on activity toy device. The ride-on toy device includes a seat, a connector and a base. The seat is stylized as a friendly character and includes a saddle/seating area (e.g., a saddle formed on the character's back). The connector supports the seat above a base, the base contacting and stabilizing the device on a supporting surface in a manner that allows multiple degrees of freedom between the seat and the connector.

Specifically, the present invention seat is stylized as an animal character (e.g., a horse, zebra, camel etc.). The back of the animal character may include a seating area stylized a saddle. A connector, in accordance with the present invention, may support the seat above a base (and thus also above the supporting surface) and may include a first connector portion and a second connector portion. The first connector portion being connected to the seat and the second connector portion being connected to the base.

A connector in accordance with the present invention may be connected to the seat at a connection portion located on the bottom of the seat. The connector may be in the form of a compressible column and includes an upper column portion or first connector portion that moves telescopically relative to a lower column portion or second connector portion. The upper end of the first connector portion may be connected to the seat and the lower end of the second connector portion may be connected to the base. When a child sits on the seating area of the seat, the force of the child's weight is transmitted through the first connector portion to a biasing member to compress the biasing member and force the first connector portion toward the second connector portion, thus reducing the overall length of the connector. Furthermore, a child who sits on the seat with their legs touching the ground can adjust the force applied to the biasing member to initiate a bouncing (up and down in the vertical direction) movement with the seat.

In order to provide a safe play experience, the present invention includes a safety mechanism that prevents the seat from rotating relative to the base when insufficient force is applied to the biasing member, but allows the seat portion to rotate relative to the base when sufficient compressive force (e.g., the weight of the child) is applied to the seat (and thus, the biasing member). The safety mechanism includes a first series of projections associated with the connector's first connector portion and a second series of projections that are associated with the connector's second connector portion.

When insufficient compressive force is applied to the biasing member, the biasing member forces the first series of projections toward the second series of projections such that the first and second series of projections are in rotational alignment (i.e., they are interlocked). When the first and second series of projections are in rotational alignment, rotation of the seat, and thus, rotation of the first connector portion, causes the first series projections to engage with the second series of projections to prevent rotation of the seat about a vertical axis. However, when sufficient compressive force (e.g., weight of a child) is applied to the seat and thus to the biasing member, the first series of projections separates from the second series of projections (the first and second series of projections are moved out of rotational alignment). As a result, when a relative rotational force is applied between the seat and the base, the first series of projections rotates freely about a vertical axis relative the second series of projections. In other words, when the seat along with the first connector portion is sufficiently compressed relative the second connector portion, the seat is allowed to rotate freely about a vertical axis relative to the second connector portion and the base.

In use, when a child attempts to mount the seat, because the seat is yet unloaded, the biasing member engages the safety mechanism to prevent the seat portion from rotating about a vertical axis relative to the base. However, when the child has mounted the seat, the weight of the child compresses the biasing member to disengage the safety mechanism allowing the seat portion to rotate about a vertical axis relative to the base (as well as bounce up and down on the vertical axis).

Along with a seat, the ride-on toy of the present invention may also include a hand grip for stability. A hand grip also helps to allow a child to transfer motion energy to this self-energized toy. In addition, the ride-on toy of the present invention may include an electronic entertainment device with sensors that are added to detect operation (motion energy) of the ride-on toy and trigger sensory stimulating output (e.g., lights, sounds etc.) to increase the entertainment experience of the child.

BRIEF DESCRIPTION OF THE DRAWINGS

Like reference numerals have been used to identify like elements throughout this disclosure.

DETAILED DESCRIPTION OF THE INVENTION

Figure 1A:
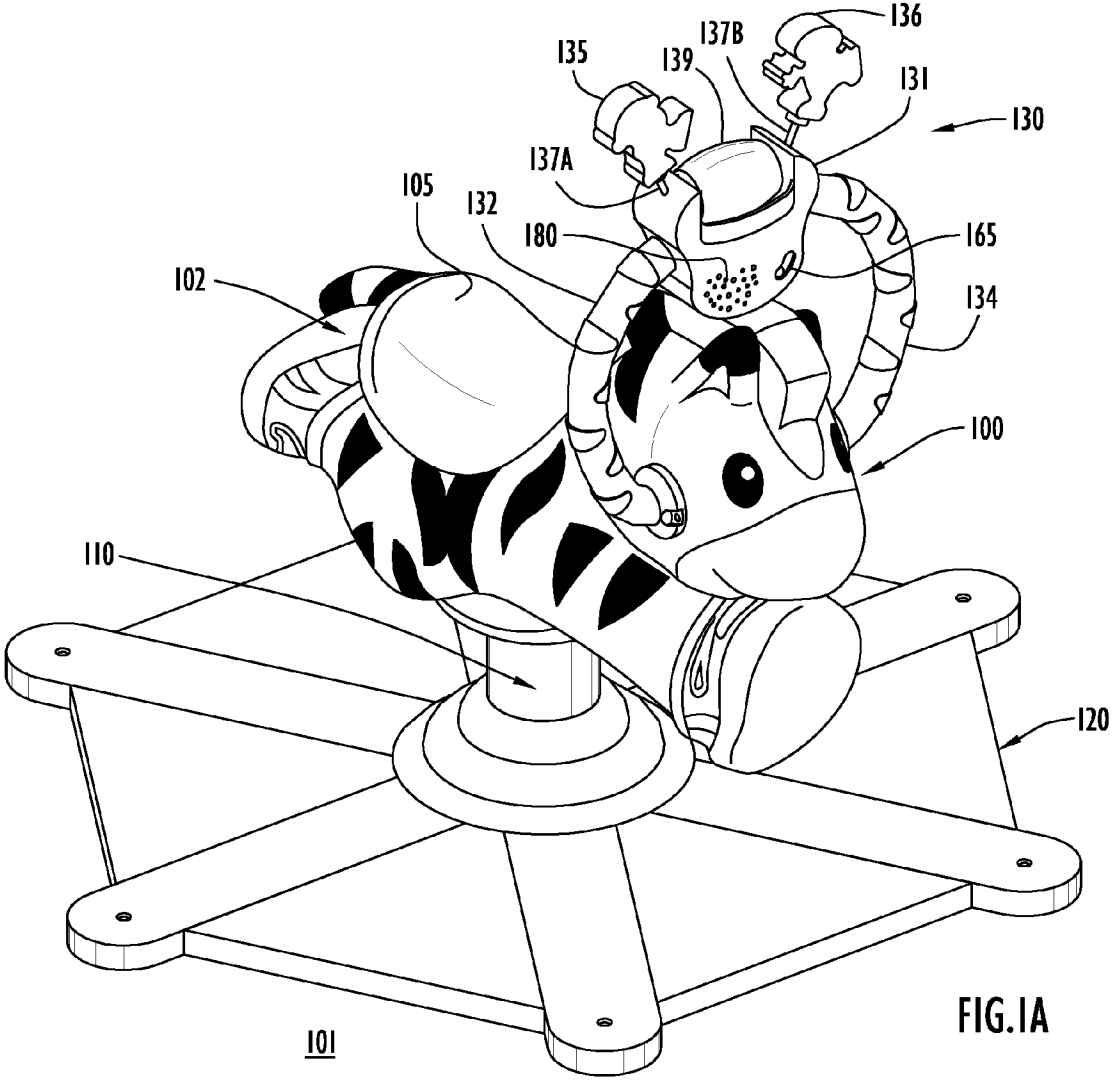
FIG. 1A illustrates a perspective view of the ride-on activity device in accordance with the present invention.

In accordance with the present invention, a ride-on activity device 100 is disclosed. FIG. 1A illustrates a perspective view of the ride-on activity device 100 in accordance with the present invention. The device 100 includes a base 120 for stabilizing the ride-on activity toy on a supporting surface (floor) 101, a seat 102 on which a child sits and a connector 110 for connecting and movably supporting the seat above the supporting surface 101. A child sitting on the seating area 105 of the seat 102 with their feet on the base 120 can bounce up and down (along a vertical axis) relative to supporting surface 101 and spin (about the vertical axis) relative to supporting surface 101.

The seat 102 is stylized as a friendly character or other attractive object. Specifically, as illustrated, the toy 100 can be stylized as animal and the seating area 105 can be stylized as a saddle. The base 120 serves as a stabilizer for the device 100 on the supporting surface 101. Thus, the base 120 functions to prevent the device 100 from tipping over. The base 120 also serves as a foot rest for a child using the device 100. The base 120 could be eliminated if the connector 100 is otherwise secured to the supporting surface 101.

Figure 1B:
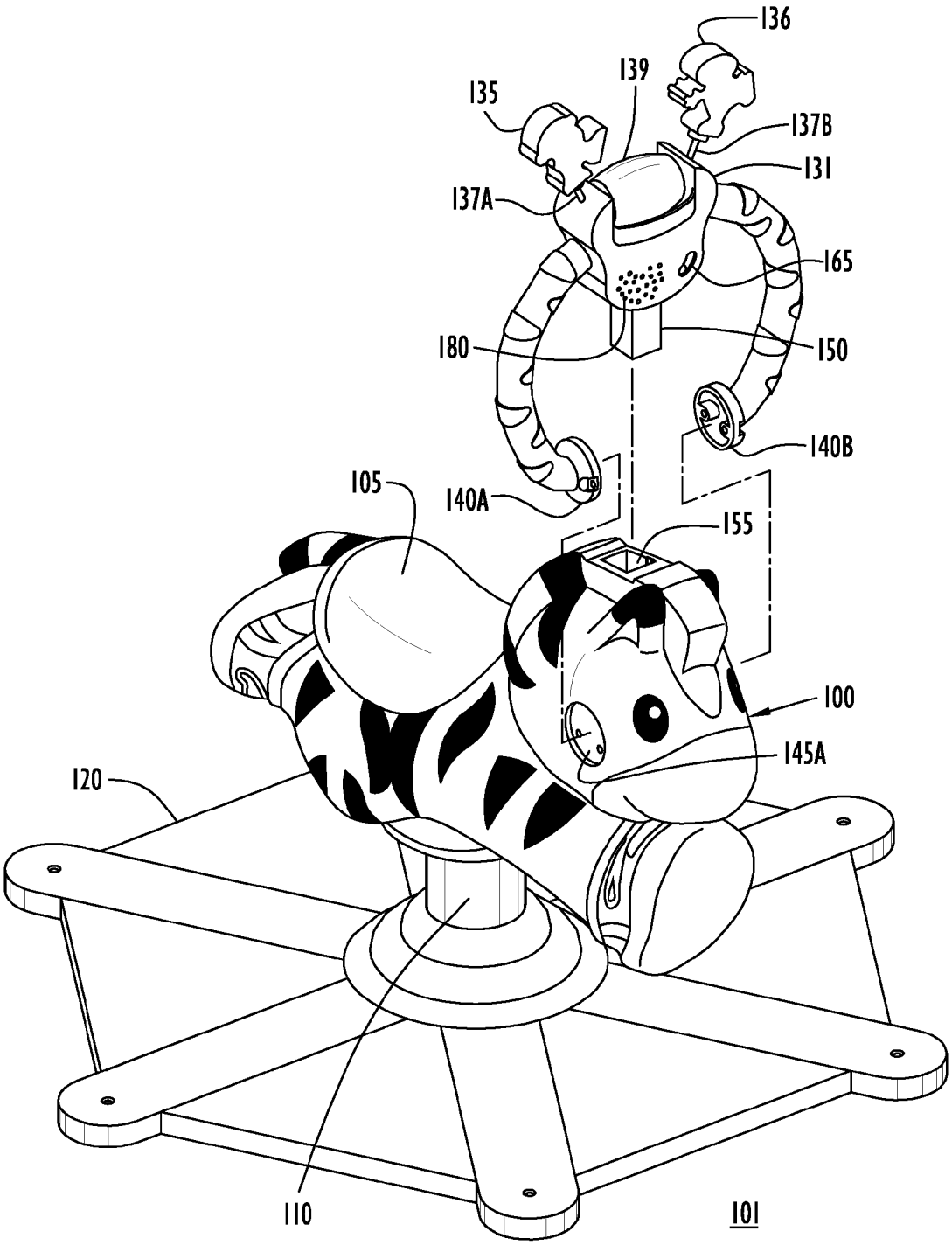
FIG. 1B illustrates a perspective view of the ride-on activity device of the FIG. 1A showing how an electronic entertainment device interconnects with the ride-on activity device.

FIG. 1B illustrates a perspective view of the ride-on activity device 100 of the FIG. 1A showing how an electronic entertainment device 130 interconnects with the ride-on activity device 100. The electronic entertainment device 130 connects to the head portion of the animal character and includes a handle portion 132, 134 and an electronics unit 131. The handle portion includes two handle members 132, 134 that connect to the head of the animal character. The handle members 132, 134 provide handles with which a child can stabilize themselves while the child is bouncing and spinning on the seating area 105. In mounting the electronic entertainment member 130 to the device 100, each handle member 132, 134 includes an end connector 140A, 140B which are respectively received in openings 145A and 145B (145B not visible in FIG. 1B) in the head of the animal character. A further support connection is made between the electronic entertainment device 130 and the device 100 as the post 150 of the electronic entertainment device 130 is received in the receptacle 155 in the head of the animal character. The handle members 132, 134 also support the electronics unit 131 therebetween.

Figure 1C:
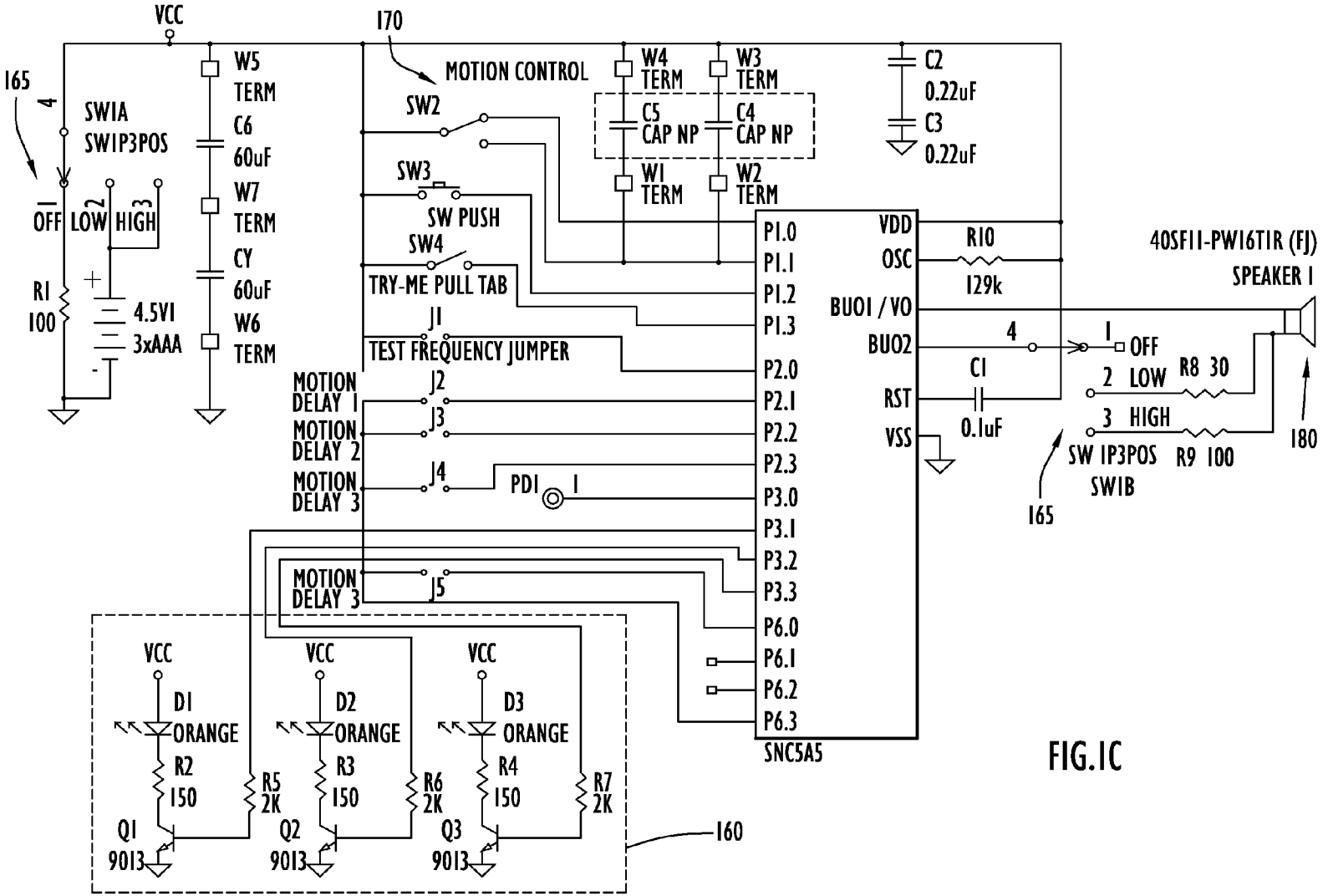
FIG. 1C illustrates an electronic schematic of the electronic entertainment device of FIG. 1B.

FIG. 1C illustrates an electronic schematic of the electronics unit 131 of the electronic entertainment device 130 of FIG. 1B. The general operation of the electronics unit 131 is managed by a microprocessor/controller 175 powered when ON/OFF switch 165 is turned to the ON position. The electronics unit 131 further includes a conventional motion switch 170 for triggering sensory output (e.g., sounds, lights, vibration etc.). Other types of switches may be employed that receive external input (e.g., sound, motion, pressed button, etc.) signals from the inputs and transmit those signals to the controller 175 for processing. Upon receipt of activation signals from the various inputs, the controller 175 then triggers a number of colorful LEDs 160 and a speaker 180 to generate sensory output (including music and/or sound effects).

Furthermore, the electronic entertainment device 130 includes attractive entertainment characters that are mechanically connected to the electronic electronics unit 131 by resilient members 137A, 137B (e.g., springs etc.). In addition, the electronics unit 131 includes a mechanical roller 139 containing a switch for triggering electronic sensory stimulation (e.g., sounds and lights) to encourage a child to spin the roller 139.

Figure 2:
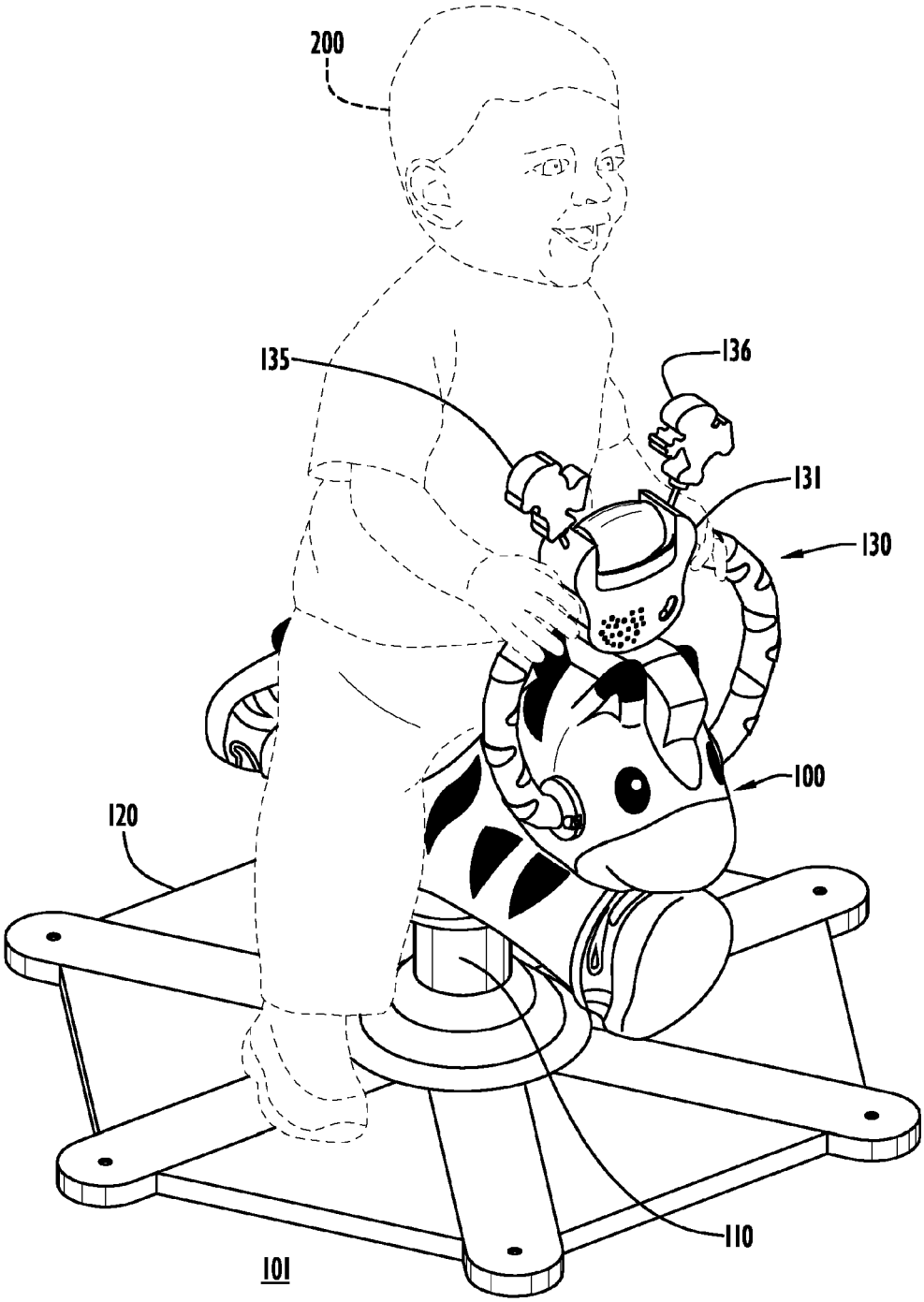
FIG. 2 illustrates a child (in phantom lines) seated on the ride-on activity device of FIG. 1A with their feet on the base and clutching the handle members of the electronic entertainment device.

FIG. 2 illustrates a child 200 (in phantom lines) seated on the ride-on activity device 100 of FIG. 1A with their feet on the base 120 and clutching the handle members 132, 134 of the electronic entertainment device 130. In this position, the child 200 can bend their knees to bounce up and down (along a vertical axis) on the device 100. The connector 110 enables the seat 102 to bounce relative to the base 120 as further described below.

Figure 3:
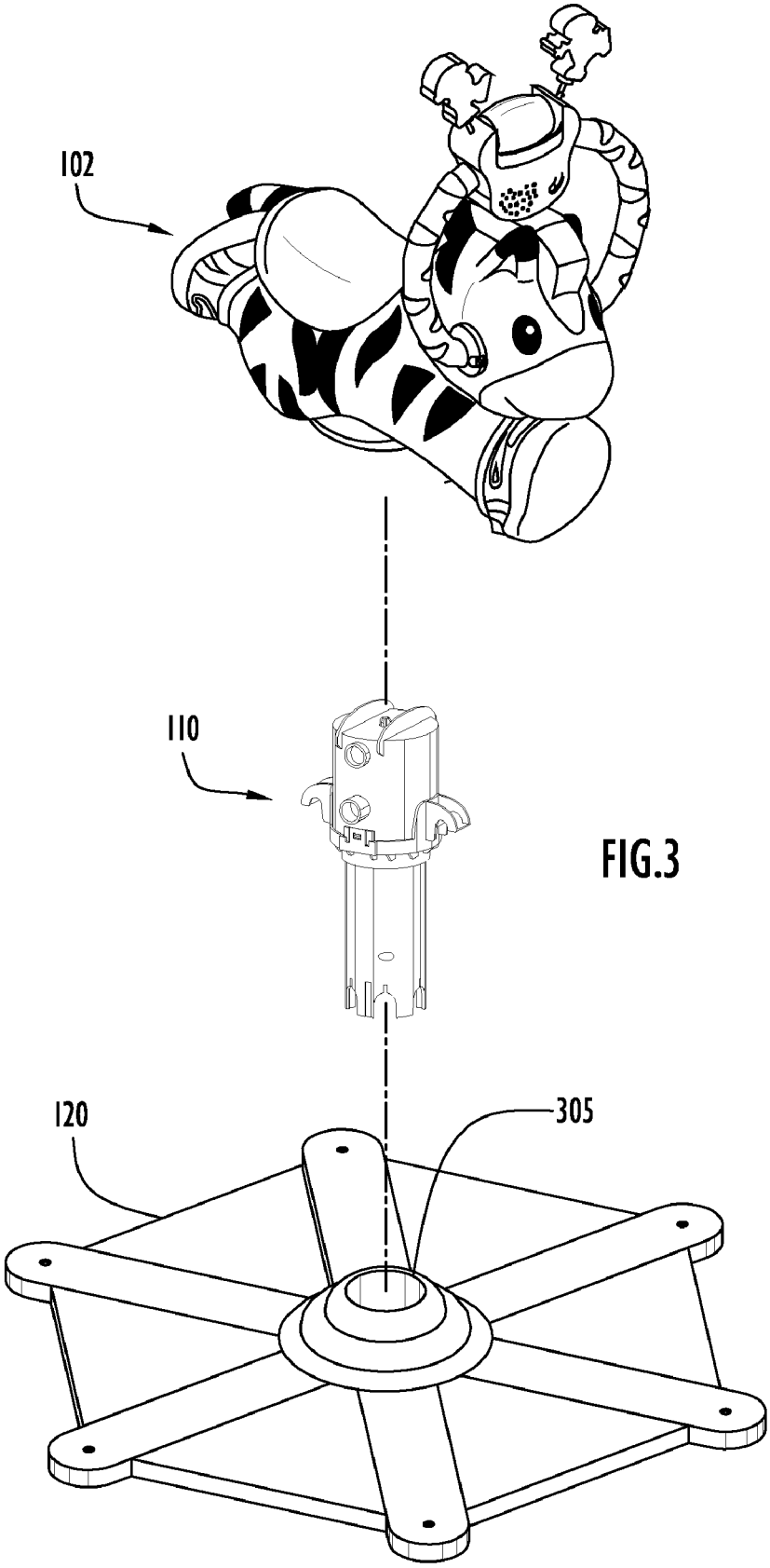
FIG. 3 illustrates an exploded view of the ride-on activity device of the FIG. 1A showing the seat, the connector, and the base.

FIG. 3 illustrates an exploded view of the ride-on activity device 100 of FIG. 1A showing the seat 102, the connector 110, and the base 120. Specifically, FIG. 3 shows how the connector 110 is positioned between the base 120 and the seat 102. A portion of the connector 110 fits into an opening 305 in the base 120 and is secured to the base 120. The pivotal connection between the connector 110 and the seat 102 will be described below.

Figure 4:
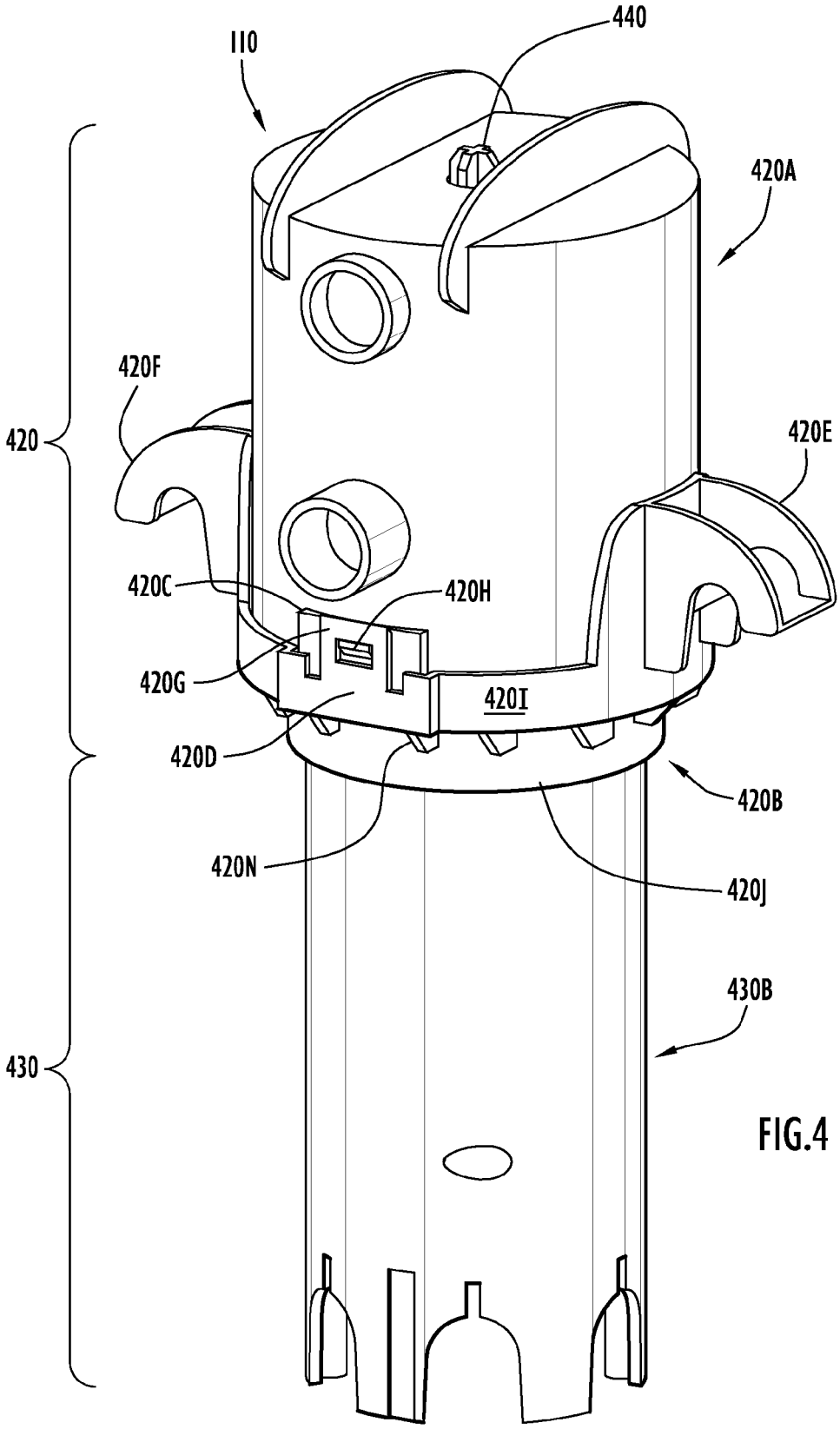
FIG. 4 illustrates an enlarged perspective view of a connector in accordance with the present invention showing the first (upper) connector portion assembled onto the second (lower) connector portion.

FIG. 4 illustrates an enlarged perspective view of a connector 110 in accordance with the present invention showing the first (upper) connector portion (generally designated as 420) assembled onto the second (lower) connector portion (generally designated as 430). First connector portion 420 is separable into a cover member 420A and a lower ring 420B. Cover member 420A and lower ring 420B are connectable by snapping cover member 420A onto lower ring 420B. Cover member 420A includes projection 420H, disposed on guide member 420C. Lower ring 420B includes a catch member 420G having an opening for receiving projection 420H when catch member 420G is slid onto projection 420H. Lower ring 420B also includes a receiver 420D that is engaged by guide member 420C to ensure alignment between catch member 420G and projection 420H. Also, as the cover member 420A is snapped onto lower ring 420B, flange 420I receives the lower edge (not shown) of the cover member 420A. Furthermore, FIG. 4 shows reinforcement ribs 420N and a bias guide 440 extending from an opening in cover member 420A and also shows securing members 420E, 420F for securing the first connector portion 420 to the underside of the seat 102.

As mentioned above, the connector 110 securely supports the seat 102 above the base 120 while allowing the seat 102 the freedom to bounce up and down (along a vertical axis) and to rotate relative to the base 120 (about a vertical axis). To this end, the first connector portion 420, moves telescopically up and down relative to second connector portion 430. In other words, as cover member 420A is compressed downward relative to column post 430B, cover member 420A, guide ring 420J, and the lower ring 420B slide downward relative to column post 430B. The relative telescopic movement between the first connector portion 420 and the second connector portion 430 is more clearly illustrated in the figures below. Furthermore, the rotational relationship between the first connector portion 420 and the second connector portion 430 will be discussed below in conjunction with the \rotation safety feature of the device 100.

Figure 5:
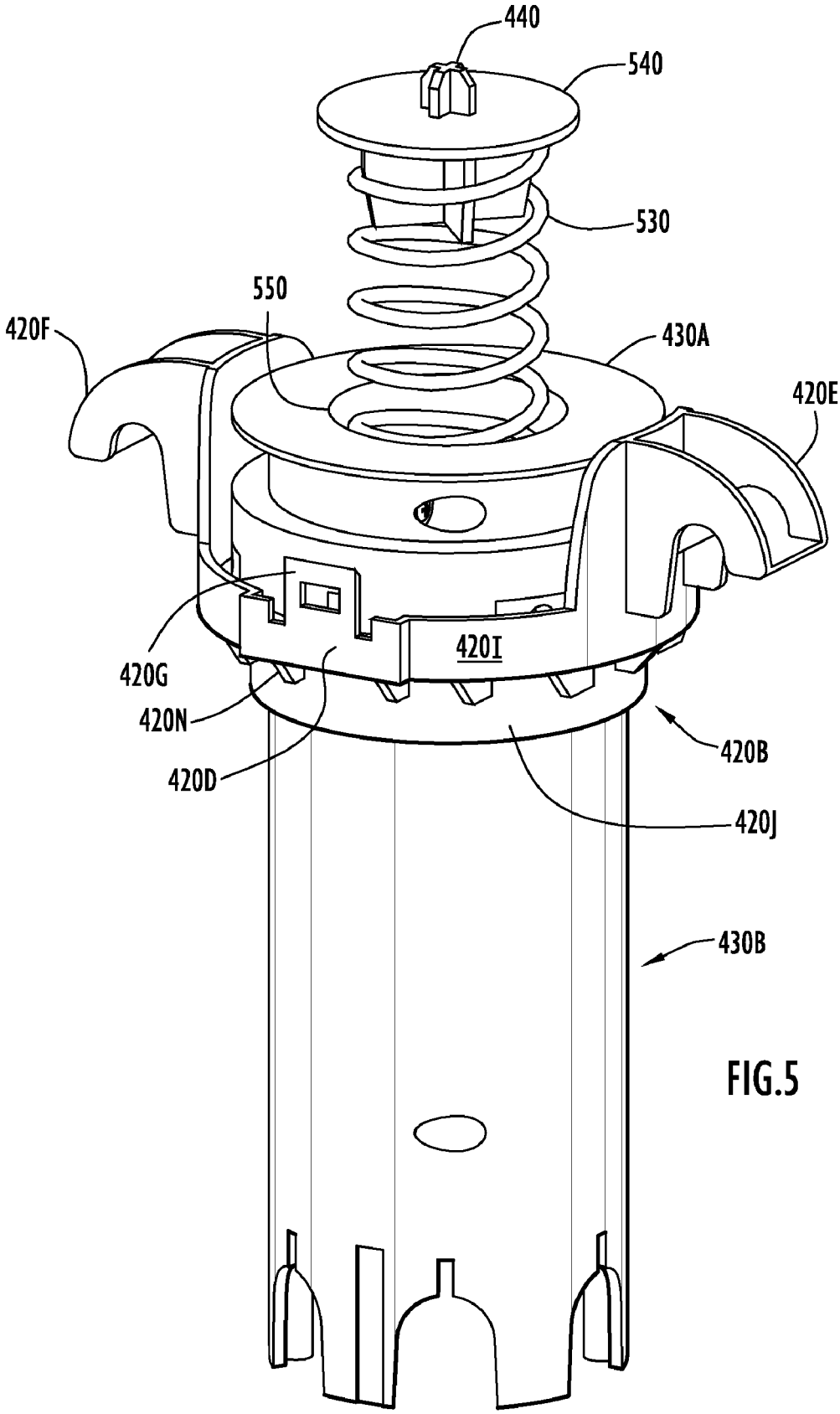
FIG. 5 illustrates an enlarged perspective view of the unloaded connector of FIG. 4 (with the cover member of the first connector portion removed to expose the internal workings of the connector).

FIG. 5 illustrates an enlarged perspective view of the unloaded connector 110 of FIG. 4 with the cover member 420A of the first connector portion 420 removed to expose the internal workings of the connector 110. The cover member 420A is removed to reveal interior portions of the connector 110 including the biasing member 530 that provides the resilience for the vertical bouncing feature of the device 100. FIG. 5 also shows an upper stop 430A of the column post 430B that limits the relative compression between the first connector portion 420 and the second connector portion 430 by limiting the overall downward travel of the cover member 420A. Biasing member opening 550 is disposed in the upper stop 430A for receiving the biasing member 530. The biasing member 530 rests on a biasing surface (not shown) that is fixed relative to the second connector portion 430. When loaded, the biasing member 530 is compressed between the biasing surface (not shown) and the biasing guide 540. In other words, when the cover member 420A pushes the bias guide 540 downward, bias guide 540 in turn compresses the biasing member 530 against the biasing surface (not shown). When the compressive force is released, the biasing member 530 exerts a reactive force back against the cover member 420A to urge the seat 102 back upward. Therefore, the up and down bouncing motion is accomplished by cyclically loading the biasing member 530 and releasing the load as the child bounces up and down on the seat 102.

As discussed above, in addition to the up and down bouncing motion, the connection between the connector 110 and the seat 102 allows the seat 102 to rotate about a vertical axis relative to the base 120. However, this rotational connection mechanism of the present invention includes a safety feature that prevents rotation in certain situations when rotation might be inconvenient or unsafe for a child. More specifically, the connector 110 includes a safety mechanism that enables a child to mount and dismount the seat 102 without fear that the rotating seat 102 will cause a potential instability.

Figure 6:
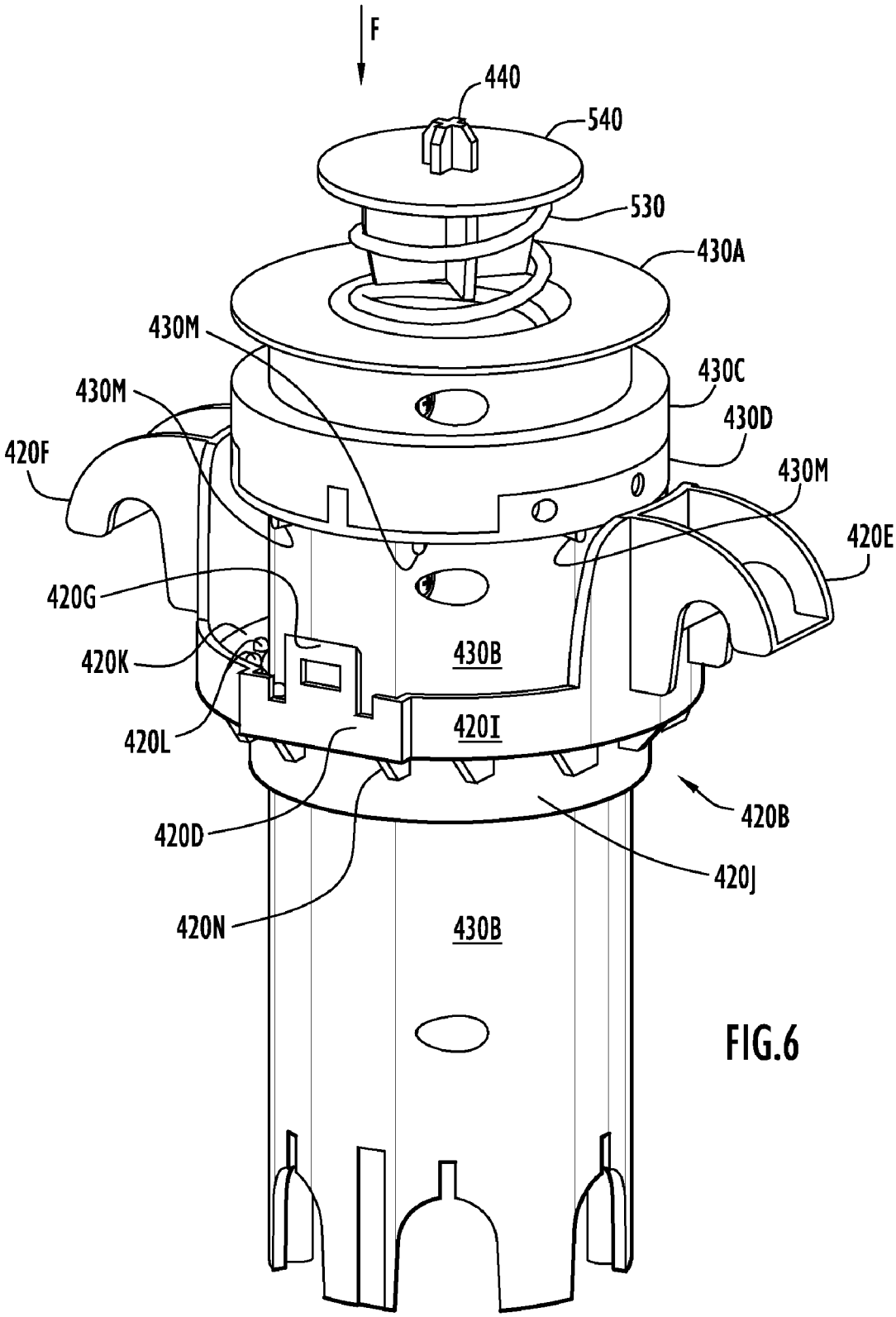
FIG. 6 illustrates an enlarged perspective view of the connector of FIG. 5 with the biasing member and the first connector portion in the loaded position.

FIG. 6 illustrates an enlarged perspective view of the loaded connector 110 of FIG. 5 with the biasing member 530 and the first connector portion 420 in the loaded position. In FIG. 6, the bias guide 540 is shown in a lower, more compressed state, than that shown in FIG. 5 to illustrate its configuration under compression by a force F (caused by a child sitting on the seat 102). Correspondingly, the lower ring 420B is shown in a lowered compressed state relative to that shown in FIG. 5. In the compressed configuration of FIG. 6, the inner ring surface 420K of the lower ring 420B and the lower stop 430D can be seen. When the lower ring 420B is shown in the compressed configuration illustrated in FIG. 6, the ring projections 420L disposed on the inner ring surface 420K of the lower ring 420B are visible and the stop projections 430M disposed on underside surface the lower stop 430D are also visible.

The rotation safety feature of the device 100 in accordance with the present invention will now be discussed. In a non-compressed state (as illustrated in FIG. 5), lower stop 430D of the second connector portion 430 and ring surface 420K of the first connector portion 420 remain close to each other such that stop projections 430M engage with ring projections 420L to prevent relative rotation between lower ring 420B and lower stop 430D. In other words, when an insufficient compressive force F (insufficient to compress the biasing member 530) is applied to the connector 110, ring projections 420L rotatably engage stop projections 430M to prevent the first connector portion 420 from rotating relative to the second connector portion 430. On the other hand, when the seat 102 is sufficiently loaded (sufficient to compress the biasing member 530), it in turn sufficiently loads the first connector portion 420 to cause clearance between ring projections 420L and stop projections 430M. Therefore, when sufficient compressive force is present such as illustrated in FIG. 6, lower ring 420B, cover member 420A, and thus the seat 102 is freely rotatable relative to second connector portion 430.

Figure 7:
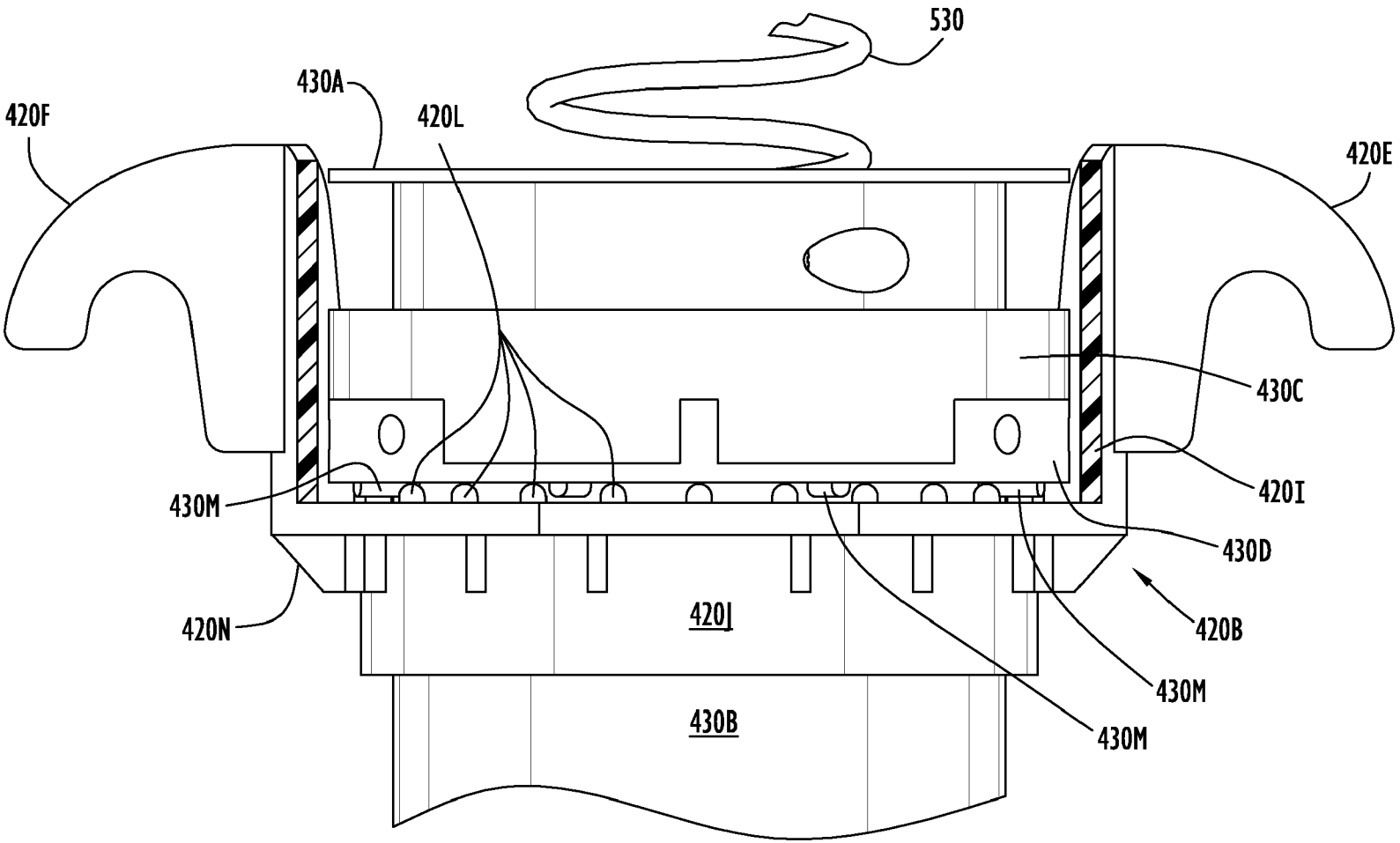
FIG. 7 illustrates a close-up side view of the connector of FIG. 5 with the side walls of the cover member and flange of the first connector portion removed to expose the connector's rotational safety feature.

FIG. 7 illustrates an enlarged cut away view of the connector 110 in an unloaded state as also illustrated in FIG. 5. In the FIG. 7 illustration, flange 420I is partially removed to more clearly show ring projections 420L and stop projections 430M in a rotational alignment which prevents rotation of the first connector portion 420 relative to the second connector portion 430.

Figure 8:
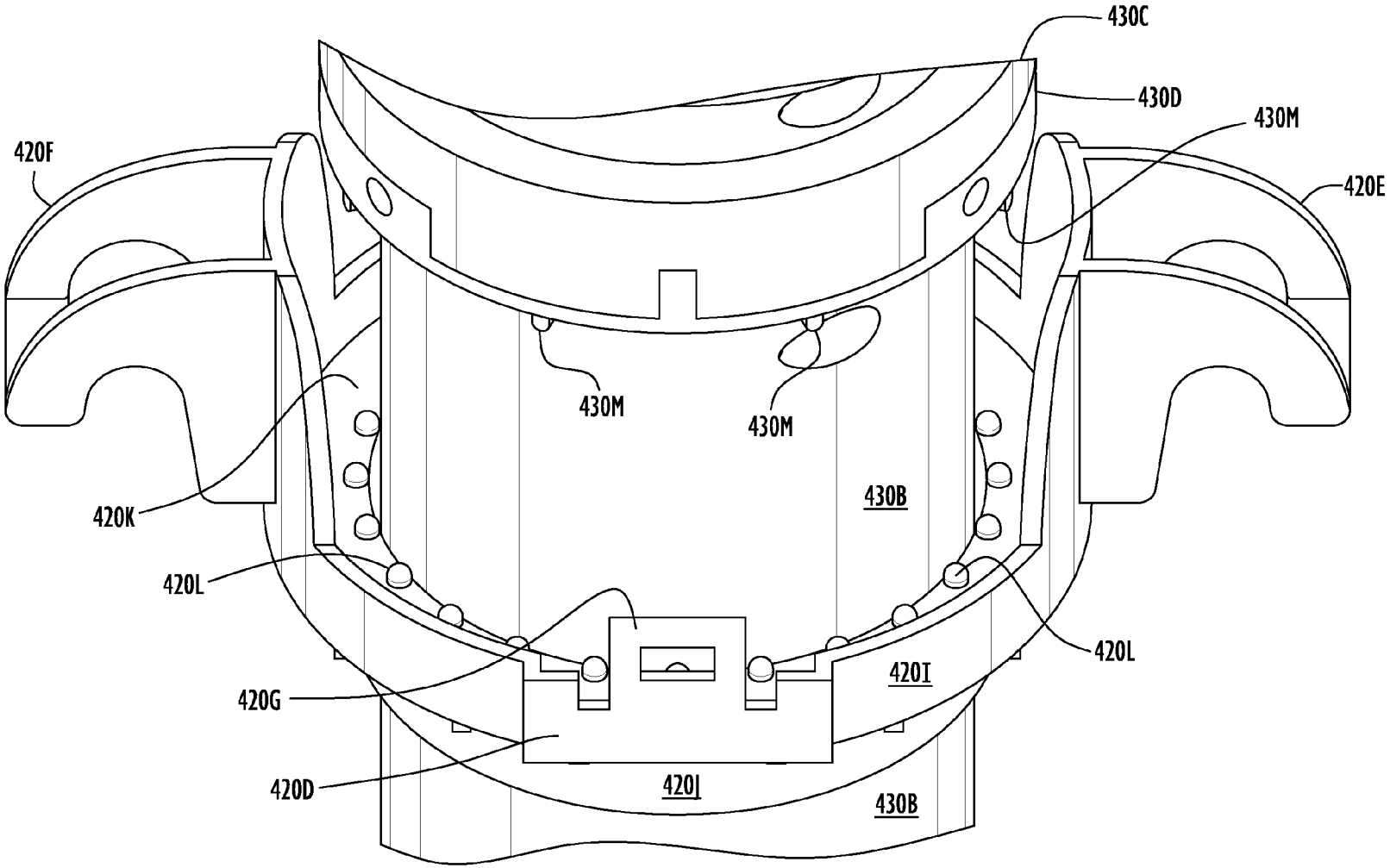
FIG. 8 illustrates a close-up perspective view of the loaded connector of FIG. 6 with the side walls of the cover member and flange of the first connector portion removed to expose the connector's rotational safety feature.

FIG. 8 illustrates an enlarged perspective view of the connector 110 of the invention in a compressed configuration (as also illustrated in FIG. 6) that separates the ring projections 420L and the stop projections 430M out of rotational alignment with each other. Again, the separation of ring projections 420L and stop projections 420M enable relative rotation between first connector portion 420 and second connector portion 430.

Figure 9:
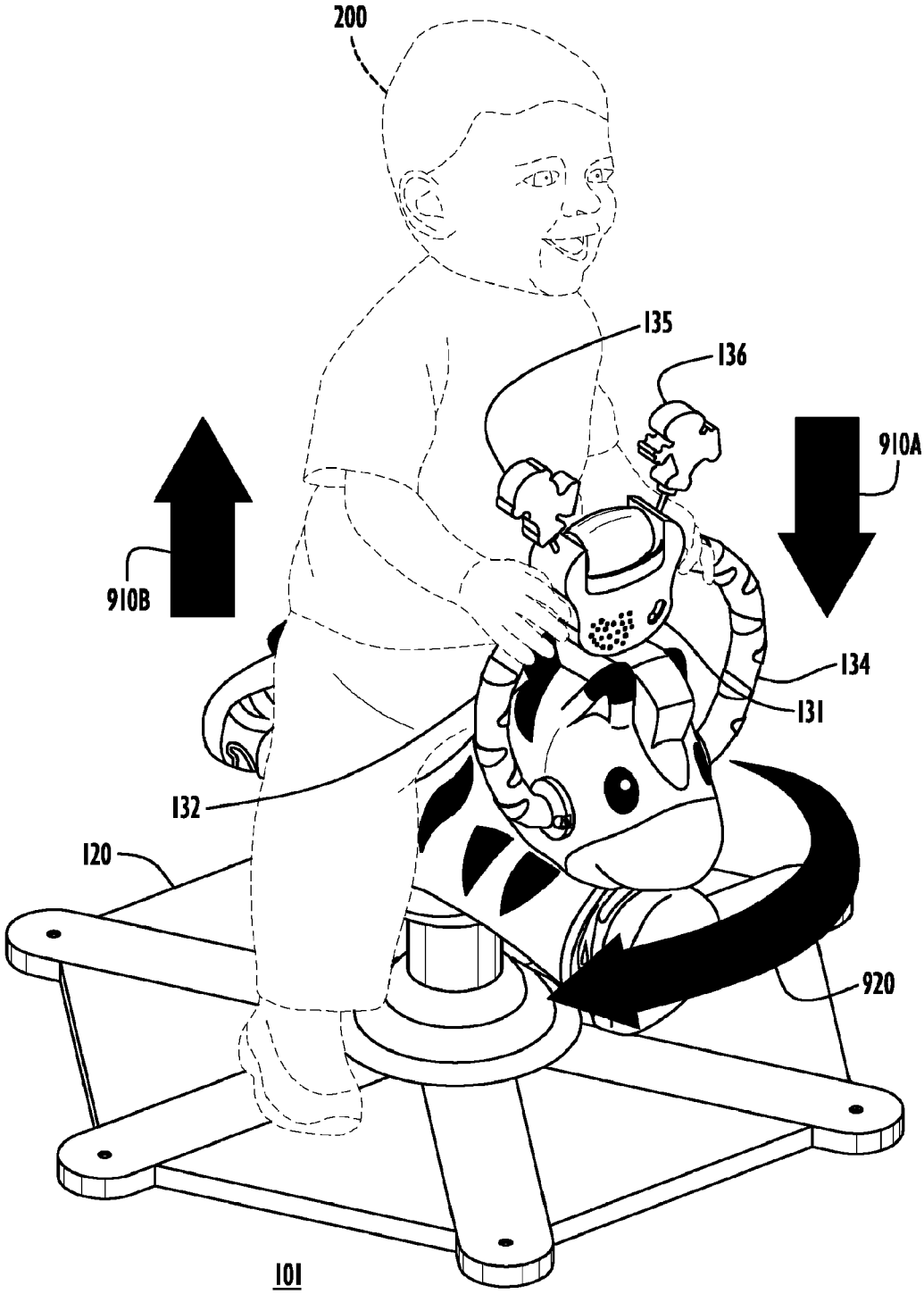
FIG. 9 illustrates a child sitting on a ride-on device in accordance with the present invention moving the device in directions indicated by the directional arrows.

FIG. 9 illustrates a ride-on activity device 100 of FIG. 1A in accordance with an embodiment of the present invention showing arrows indicating the direction of a child bouncing and rotating on the device 100. In use, a child 200 approaches the ride-on activity device 100 and attempts to mount the device 100. During mounting, the child 200 benefits from being able to support himself/herself against the seat 102 that does not rotate when urged (e.g., when swinging a leg around the back of the seat 102). The device 100 allows the child 200 to mount the seat 102 with maximum support by preventing rotation during mounting. After, the child 200 has mounted the seat 102, the weight of the child will load the bias member 530 and allow the child 200 to bounce up and down on the seat as indicated in FIG. 9 by arrows 910A, 910B. In addition, the bias member 530 is chosen such that the weight of the child 200 sufficiently loads the seat 102 and thus the first connector portion 420 to force the connector 110 to the compressed configuration as discussed above (with respect to FIGS. 6 and 8). In this compressed configuration, the safety rotation mechanism disengages (causing ring projections 420L to be separated from stop projections 430M) to allow the seat 102 to freely rotate as indicated in FIG. 9 by arrow 920. The child 200 will then be able to freely bounce and rotate. When the child 200 is ready to dismount, the child 200 rises from the seat 102 to unload the connector 110. Unloading the device 100 causes the rotation safety mechanism to again engage (causing ring projections 420L to be in contact with stop projections 430M) to prevent rotation so that the child 200 can support themselves as they dismount safely.

It will be appreciated that the embodiments described above and illustrated in drawings represent only a few of the many ways of implementing the present invention. For example, the relative movement between the seat 102 and the base 120 or supporting surface 101 is due to the connections between the seat 102 and connector's first connector portion 420, between the connector's first connector portion 420 and the connector's second connector portion 430, or the connector's second connector portion 430 and the base 120. In other words, relative movement between the seat 102 and base 120 can be due to any of the foregoing connections. Specifically, the rotation between the seat 102 and the base 120 may be due to the connection between the second connector portion 430 and the base 120 rather than between the first connector portion 420 and the seat 102.

The connection between the seat 102 and the connector 110 can be located anywhere on the seat 102, but is shown on the bottom of the seat 102 in the drawings. The connection between the first connector portion 420 and the second connector portion 430 can be of any type, but is shown as a telescopic connection in the drawings. The connection between the second connector portion 430 and the base 120 can be any type of connection and can be similar to the connection between the first connector portion 420 and the seat 102.

The connection between the seat 102 and first connector portion 420 may be in an upper portion of the seat 102 when the connector 110 is an overhead support (not shown in the drawings). Alternatively, the connection between the seat 102 and first connector portion 420 may be in a lower portion of the seat 102 when the connector 110 is a column-type support.

The electronics assembly 130 in accordance with the present invention may include any combination of sensors, switches, lights, speakers, animated members, motors, and sensory output generating devices. The microprocessor unit 175 may produce any combination of audio and visual effects including, but not limited to, animation, lights, and sound (music, speech, and sound effects). The output pattern is not limited to that which is discussed herein and includes any pattern of music, lights, and/or sound effects. The electronics assembly 130 may also include additional switches or sensors to provide additional sensory output activation without departing from the scope of the present invention.

Thus, it is intended that the present invention cover the modifications and variations of this invention that come within the scope of the appended claims and their equivalents. For example, it is to be understood that terms such as "left", "right" "top", "bottom", "front", "rear", "side", "height", "length", "width", "upper", "lower", "interior", "exterior", "inner", "outer" and the like as may be used herein, merely describe points of reference and do not limit the present invention to any particular orientation or configuration.

We claim:

1. An amusement apparatus comprising:

a seat for receiving a child;

a base supporting said seat above a supporting surface;

a connector for connecting said seat to said base, said connector comprising a first connector portion and a second connector portion, said seat being coupled to said first connector portion such that the seat is disposed above the base, and said base being coupled to said second connector portion, said first connector portion being displaceable with respect to said second connector portion such that the connector allows movement of said seat along a vertical axis with respect to said base; and a biasing member operably coupled to at least one of said first connector portion and said second connector portion, wherein said seat is rotatable about said vertical axis in a first vertical position of said seat and said seat is rotatably fixed with respect to said vertical axis in a second vertical position.

2. The amusement apparatus of claim 1, wherein said first and second connector portions of said connector are connected in a telescopic relationship to allow movement of said seat along said vertical axis.

3. The amusement apparatus of claim 2, wherein said biasing member is operable to provide a biasing force along said vertical axis to resist downward movement of said seat along said vertical axis.

4. The amusement apparatus of claim 1, wherein said seat is positioned in said first vertical position when a child is received in said seat, and said seat is positioned in said second vertical position when no child is received in said seat.

5. The amusement apparatus of claim 1, wherein said biasing member provides a biasing force along said vertical axis.

6. The amusement apparatus of claim 1, wherein said seat is prevented from rotation with respect to said vertical axis in said second vertical position by a lock mechanism including a first lock member and a second lock member.

7. The amusement apparatus of claim 6, wherein said first lock member is disposed on one of said first connector portion or said second connector portion of said connector and said second lock member is disposed on the other of the first connector portion or the second connector portion of said connector.

8. The amusement apparatus of claim 7, wherein said first lock member includes at least one first projection and said second lock member includes at least one second projection.

9. The amusement apparatus of claim 8, wherein when said seat is in said second vertical position, said at least one first projection and said at least one second projection contact each other to prevent rotation of the seat with respect to said vertical axis.

10. The amusement apparatus of claim 8, wherein when said seat is in said first vertical position, said at least one first projection and said at least one second projection are free of contact with each other to allow rotation of the seat with respect to said vertical axis.

11. The amusement apparatus of claim 1, further including a motion sensor configured to sense movement of said seat, said motion sensor triggering sensory stimulating output upon said movement.

12. The amusement apparatus of claim 11, wherein said sensory stimulating output is one of auditory output and visual output.

13. An amusement apparatus comprising:

a seat for receiving a child;

a base supporting said seat above a supporting surface, said seat being disposed above the base;

means for connecting said seat to said base, said means for connecting including a first connector portion displaceable with respect to a second connector portion, wherein said means for connecting is configured to permit movement of said seat along a vertical axis with respect to said base;

biasing means operably coupled to at least one of said first connector portion and said second connector portion; and means for triggering at least one of audible and visual sensory stimulating output upon movement of said seat along said vertical axis, wherein said seat is rotatable about said vertical axis in a first vertical position of said seat and said seat is rotatably fixed with respect to said vertical axis in a second vertical position.

14. The amusement apparatus of claim 13, wherein said seat is connected to said first connector portion and said base is connected to said second connector portion.

15. The amusement apparatus of claim 14, wherein:

said first and second connector portions are connected in a telescopic relationship to allow movement of said seat along said vertical axis, and said biasing means is configured to provide a biasing force along said vertical axis to resist downward movement of said seat along said vertical axis.

16. The amusement apparatus of claim 15, wherein said seat is positioned in said first vertical position when a child is received in said seat, and said seat is positioned in said second vertical position when no child is received in said seat.

17. The amusement apparatus of claim 16, wherein said seat is prevented from rotation with respect to said vertical axis in said second vertical position by a lock mechanism including a first lock member and a second lock member.

18. The amusement apparatus of claim 17, wherein said first lock member includes at least one first projection and said second lock member includes at least one second projection, wherein when said seat is in said second vertical position, said at least one first projection and said at least one second projection contact each other to prevent rotation of the seat with respect to said vertical axis, and wherein when said seat is in said first vertical position, said at least one first projection and said at least one second projection are free of contact with each other to allow rotation of the seat with respect to said vertical axis.

19. An amusement apparatus comprising:

a seat for receiving a child;

a base supporting said seat above a supporting surface; and a connector for connecting said seat to said base, said connector comprising a first connector portion coupled to a second connector portion, said seat being coupled to said first connector portion such that the seat is disposed above the base, and said base being coupled to said second connector portion, wherein said first connector portion is axially displaceable with respect to said second connector portion, the connector being configured in a first connector configuration when said first connector portion is disposed at a first axial position, and in a second connector configuration when said first connector portion is disposed at a second axial position, wherein, in said first connector configuration, said connector portions are rotatably coupled, permitting rotation of said seat about a vertical axis and, in said second connector configuration, said connector portions are rotatably fixed.

20. The amusement apparatus of claim 19, wherein:

said first connector portion is axially displaceable along said vertical axis such that said connector permits movement of said seat along said vertical axis;

the seat is disposed in a first vertical position with respect to said base when the connector is disposed in said first connector configuration and said seat is disposed in a second vertical position with respect to said base when said connector is disposed in said second connector configuration; and said seat is rotatable about said vertical axis in said first vertical position and said seat is rotatably fixed with respect to said vertical axis in said second vertical position.

21. The amusement apparatus of claim 20 further comprising a motion sensor configured to sense movement of said seat, said motion sensor triggering sensory stimulating output upon movement of said seat.

22. The amusement apparatus of claim 20, wherein said seat is prevented from rotation with respect to said vertical axis in said second vertical position by a lock mechanism including a first lock member and a second lock member.

23. The amusement apparatus of claim 22, wherein:

said first lock member is disposed on one of said first connector portion and said second connector portion;

and said second lock member is disposed on the other of the first connector portion and the second connector portion.

24. The amusement apparatus of claim 23, wherein said first lock member includes at least one first projection and said second lock member includes at least one second projection.

25. The amusement apparatus of claim 19, wherein said first connector portion moves with respect to said second connector portion along said vertical axis.

* * * * *